United States Patent [19]

Laütenschläger, Jr.

[11] Patent Number: 4,615,072

[45] Date of Patent: Oct. 7, 1986

[54] CABINET HINGE

[75] Inventor: Karl Laütenschläger, Jr., Reinheim, Fed. Rep. of Germany

[73] Assignee: Karl Lautenschlager KG Mobelbeschlagfabrik, Reinheim, Fed. Rep. of Germany

[21] Appl. No.: 569,737

[22] Filed: Jan. 10, 1984

[30] Foreign Application Priority Data

Jan. 25, 1983 [DE] Fed. Rep. of Germany ..... 3302312

[51] Int. Cl.[4] ..... E05D 7/04

[52] U.S. Cl. ..... 16/238; 16/237; 403/90

[58] Field of Search ..... 16/233, 235–240, 16/242, 243, 245–249, 382, 362, 224; 403/77, 122, 90, 61, 82, 93, 115, 125, 126; 411/424, 393

[56] References Cited

U.S. PATENT DOCUMENTS

| | | | |
|---|---|---|---|
| 3,938,219 | 2/1976 | Rock et al. | 16/246 |
| 4,142,271 | 3/1979 | Busse | 16/248 |
| 4,176,422 | 12/1979 | Rock et al. | 16/235 |
| 4,265,000 | 5/1981 | Lautenschlaeger | 16/238 |
| 4,365,384 | 12/1982 | Vitt | 16/333 |

FOREIGN PATENT DOCUMENTS

| | | | |
|---|---|---|---|
| 2657628 | 6/1978 | Fed. Rep. of Germany | 16/236 |
| 1106408 | 3/1968 | United Kingdom | 16/238 |

*Primary Examiner*—Donald R. Schran
*Assistant Examiner*—James L. Wolfe

[57] ABSTRACT

A cabinet hinge having a supporting arm (24) which is adjustably mounted on a mounting plate (22) which can be fastened on the supporting wall (20) of a cabinet. The arm has a longitudinal slot (30) which is open at its cabinet-interior end and through which passes a mounting screw driven into the mounting plate (22). A headless screw (38) is driven into a tap provided nearer to the outer end of the supporting arm, and a holding block in the form of a ball (42) is provided at the bottom end of the headless screw. The holding ball is pushed into a narrow-mouthed, open-ended slot (44) that is provided in the mounting plate, which holds the ball securely against lifting while permitting it to be displaced longitudinally.

6 Claims, 6 Drawing Figures

FIG. 1
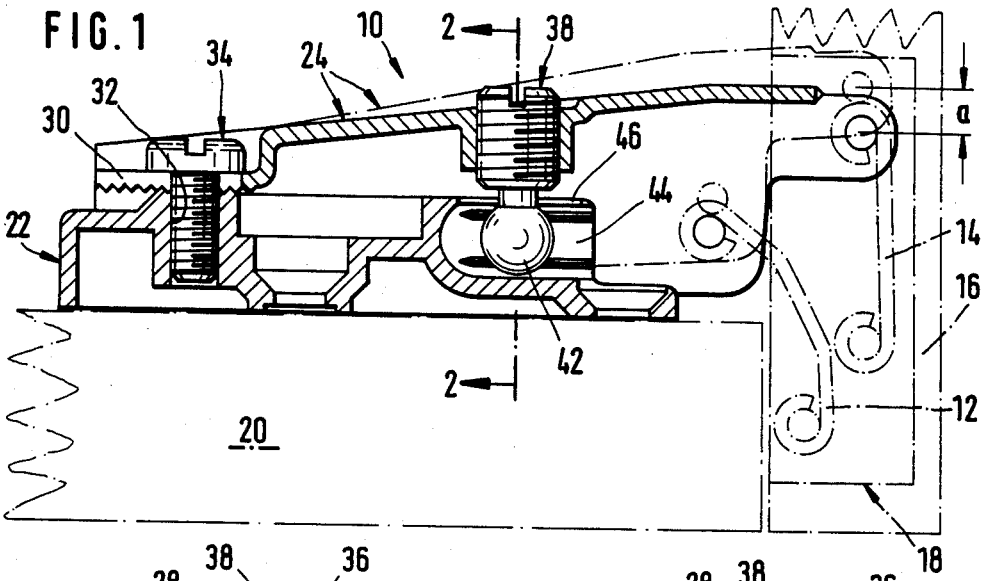
FIG. 2
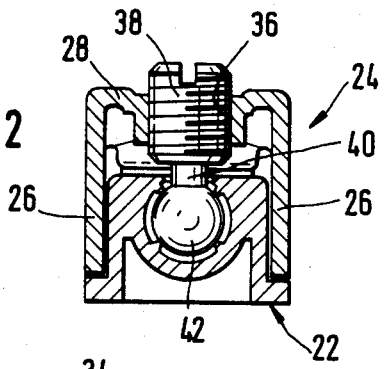
FIG. 6
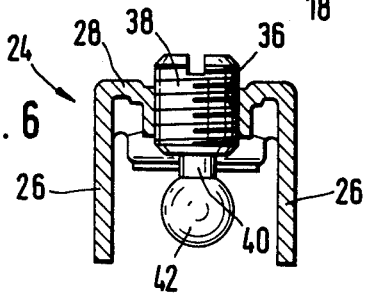
FIG. 3
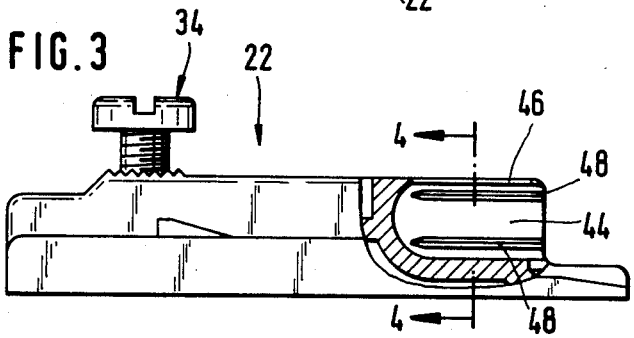
FIG. 4
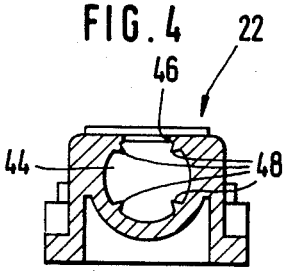
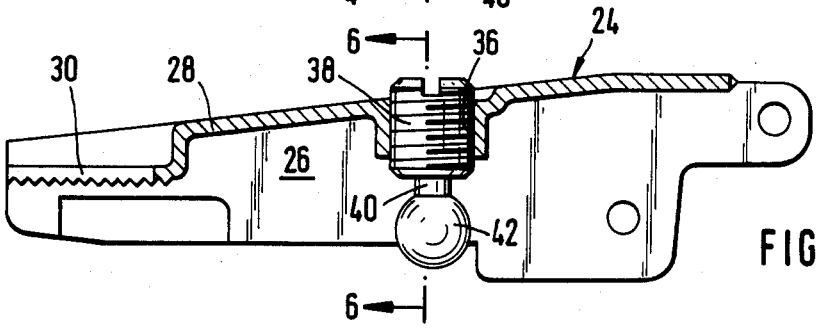
FIG. 5

CABINET HINGE

BACKGROUND OF THE INVENTION

The invention relates to a cabinet hinge whose supporting wall-related component in the form of an elongated supporting arm is mounted for longitudinal adjustment on a mounting plate which can be fastened to the supporting wall of a piece of furniture. The supporting arm is pivotingly coupled by a link mechanism to a door leaf-related component which can be fastened to a door leaf, and it has in its cabinet-interior end an open-ended longitudinal slot through which passes the shaft of a mounting screw driven into the mounting plate. A tap is provided in the supporting arm, and into this tap there is driven a headless screw which has a holding block of enlarged diameter on its bottom end. This holding block is inserted into a longitudinal, open-ended slot which is provided in the mounting plate and is narrowed at the top to secure the block so as to prevent the supporting arm from lifting away from the mounting plate.

Cabinet hinges having a supporting wall-related part which can be fastened adjustably in this manner on the corresponding mounting plate and is in the form of an elongated supporting arm are known (DE-OS No. 26 14 447), and they are becoming more widely used in recent times on account of the relatively simple and quick manner in which a door leaf provided with such hinges can be installed on the supporting wall of a cabinet carcass. It has been found, however, that the adjustment of the overlap of the door leaf, i.e., the extent to which the back of the door overlaps the end of the carcass wall, is limited, because the discoidal holding block formed on the end of the headless screw jams in its slot even though at first it is loosely held in the slot. In order nevertheless to provide a greater range of overlap adjustment, the assignee developed a hinge (U.S. Pat. No. 4,265,000) in which the supporting arm is bipartite, and in which a separately made holding block displaceably guided in the direction of adjustment relative to the rest of the supporting arm is adjusted by the headless screw. This hinge provides a considerably greater overlap adjustment without any binding of the block in the slot, but it is also more complex than the above-mentioned hinge with the one-piece supporting arm, so that it is more expensive to manufacture.

Nevertheless, it is the object of the invention to improve the known hinge with the one-piece supporting arm such that it will permit a greater range of adjustment of the door overlap without using a complex special design.

SUMMARY OF THE INVENTION

Setting out from a hinge of the kind mentioned above, this object is accomplished in accordance with the invention by replacing the holding block with a ball formed on the end of the headless screw. A ball of this kind cannot jam in its groove even if the headless screw becomes tilted in the course of the adjustment of the overlap. Thus, the previously noted limitation of the range of adjustment by such jamming is removed, i.e., a considerably greater range of adjustment is possible.

It is then desirable for the longitudinal slot in the mounting plate to have a circular cross section in order to accommodate the ball formed on the headless screw.

It is recommendable to make the diameter of the longitudinal slot in its area of circular cross section slightly larger than the diameter of the ball formed on the headless screw, and to provide a number of longitudinal ribs projecting from the wall of the slot to a level approximately equal to the radius of the slot's cross section minus the radius of the ball. The ball will thus be guided and supported by the edges of the ribs.

In this case it is desirable for the longitudinal ribs to have a cross section tapering toward their free edges, preferably a triangular or trapezoidal cross section.

To center the ball in the longitudinal slot, it is recommendable to provide the slot with at least three, and preferably four or more longitudinal ribs spaced apart from one another circumferentially.

The longitudinal edges of the ribs can also lie on the circumference of a circle included at right angles to their length and having a diameter smaller than the diameter of the ball formed on the inner end of the headless screw. The ball is thus held with a slight press fit between the ribs or is brought to the precise diameter of the ball by the deformation of the edges of the ribs, so that a zero-clearance seating of the ball between the ribs is obtained.

BRIEF DESCRIPTION OF THE DRAWINGS

The invention is further explained in the following description of an embodiment, in conjunction with the drawing, wherein FIG. 1 is a longitudinal central section through a cabinet hinge in accordance with the invention, FIG. 2 is a sectional view as seen in the direction of the arrows 2—2 in FIG. 1, FIG. 3 is a partially cut-away side view of the mounting plate of the hinge shown in FIGS. 1 and 2, FIG. 4 is a side view, partially in section, as seen in the direction of the arrows 4—4 in FIG. 3, FIG. 5 is a longitudinal central section through the supporting arm of the hinge shown in FIGS. 1 and 2, and FIG. 6 is a sectional view as seen in the direction of the arrows 6—6 in FIG. 5.

DETAILED DESCRIPTION OF PREFERRED EMBODIMENTS

The hinge of the invention, shown in FIGS. 1 and 2 and designated as a whole by the number 10, is composed of two hinge components coupled together by hinge links 12 and 14 in the manner of a four-pivot articulation, namely the door-related component which is a recess-mounted cup 18 set matingly in a recess in the back of a door leaf 16, and the supporting wall-related component which is an elongated supporting arm 24 fastened adjustably on a mounting plate 22 fastened in turn to the supporting wall 20 of the cabinet. The hinge links 12 and 14 and the recess-mounted cup 18 of the hinge 10, like the door 16 and the supporting wall 20 of the cabinet, are indicated only diagrammatically in broken lines in FIG. 1 so as not to complicate the representation of the idea of the invention, which lies in the manner in which the supporting arm 24 is adjustably fastened to the mounting plate 22.

The supporting arm 24 of the hinge 10 (see also FIGS. 5 and 6) is of channel-shaped cross section, and in the web 28 thereof it has a longitudinal slot 30 which is open at the rearward end and through which the mounting screw 34 passes which it is threaded into the mounting plate 22.

At a point closer to the forward end of the supporting arm 24 a tap 36 is provided in the web 28, and into it there is threaded a headless screw 38 on whose bottom end adjacent the mounting plate 22 a ball 42 is integrally joined to the screw by a short neck 40 of reduced diameter.

The mounting plate 22 (FIGS. 3 and 4) is provided in the area beneath the tap 36 with a slot or groove 46 which is open at the forward end facing the door and narrows at its top, and whose width is approximately equal to or only slightly larger than the diameter of the neck 40 of the headless screw 36. In the area beneath the slot opening 46, the longitudinal groove 44 has a circular cross section whose diameter is slightly greater than the diameter of the ball 42. The ball 42 at the bottom end of the headless screw can therefore be pushed from the open end into the longitudinal slot or groove 44, the neck 40 passing along through the slot opening 46. The difference in diameter between the ball 42 and the slot 44 is taken up by longitudinal ribs 48 projecting from the wall of the slot. In the embodiment represented in the figure, four longitudinal ribs 48 are provided in the slot 44 in a circumferentially spaced relationship (FIGS. 2 and 4). It is desirable for the ribs 48 to project from the wall of the slot 44 to such a distance that the diametric distance between them is slightly shorter than the diameter of the ball 42, i.e., the ball, when inserted into the groove 44, slightly deforms their arrises and then is held in a light, press fit by the ribs.

It is now apparent that the mounting of the supporting arm 24 on the mounting plate 22 can be accomplished in a simple manner by loosening the mounting screw 34 and pushing the supporting arm parallel to the supporting wall 20, with its rearward longitudinal slot 30 under the head of the mounting screw 34, causing the ball 42 to enter the open end of the slot 44. Then, within the range provided by the length of the longitudinal slots 30 and 44, the supporting arm 24 can be displaced longitudinally, parallel to the surface of the supporting wall 20. The supporting arm 24 can then be locked onto the mounting plate 22 by tightening the mounting screw 34. By turning the headless screw 38, the supporting arm can be raised or lowered relative to the mounting plate 22, so that it can be shifted, for example, from the position represented in solid lines in FIG. 1 to the position represented in broken lines in which it is rocked upwardly by the amount a. At the same time, however, the overlap of the door 16 on the edge of the supporting wall 20 is changed by the same amount a.

It is to be noted that modifications and further improvements of the embodiment described above can be made within the scope of the invention.

Thus, it can be seen that sufficient space is provided in the supporting arm area shown on the right-hand side of the headless screw 38 for the provision of an over-center mechanism, so that the hinge can be further developed into a self-closing hinge. In the hollow bottom of the mounting plate, an additional mounting plate part can be placed, which is fastened to the supporting wall 20, while the mounting plate part illustrated is made for adjustment on the mounting plate part fastened to the supporting wall 20, parallel to the hinge articulation axis. In addition to the possibilities for adjustment lengthwise of the hinge, an adjustment parallel to the hinge articulation axis can also be provided.

I claim:

1. In a hinge: an elongated mounting plate to be fastened to a supporting wall of a piece of furniture and having an upper face facing away from the supporting wall when the plate is mounted thereto, and also having a threaded bore in said upper face adjacent one end of the mounting plate and perpendicular to said upper face, an elongated supporting arm mounted for longitudinal adjustment on said mounting plate, said supporting arm having an upper face to face away from the supporting wall and a first longitudinal end area with an open-ended first longitudinal slot, a mounting screw screwed into said threaded bore of said mounting plate and having a shaft passing through said first slot, said supporting arm having a second end area with a tap therethrough extending perpendicular to the upper face of said mounting arm, said mounting plate having an open-ended second longitudinal slot at an end area adjacent said tap, a screw screwed into said tap and having connected thereto a holding block in the form of a ball received in said second slot, said second slot having a narrow longitudinal mouth in said upper face, and underneath said mouth, a portion of circular cross section for matingly accommodating said ball and for securing said ball from being lifted out of said second slot towards said supporting arm, the diameter of said circular cross sectional portion being slightly larger than the diameter of the ball, and a plurality of longitudinal ribs running in the longitudinal direction of said portion and projecting from the wall of said portion, said ribs having a height approximately equal to the radius of said portion minus the radius of said ball to engage and center the ball in said second slot.

2. A hinge according to claim 1, wherein said longitudinal ribs have a cross section which tapers in the direction of their free longitudinal edge pointing toward the ball.

3. A hinge according to claim 2, wherein the cross section of the ribs is triangular or trapezoidal.

4. A hinge according to any one of claims 1, 2 or 5, comprising at least three longitudinal ribs, offset circumferentially from one another and projecting from the wall of the second longitudinal slot.

5. A hinge according to any one of claims 1, 2 or 5, wherein the free longitudinal edges of the ribs lie on the circumference of a circle whose diameter is slightly smaller than the diameter of the ball.

6. A hinge according to claim 4, wherein the free longitudinal edges of the ribs lie on the circumference of a circle whose diameter is slightly smaller than the diameter of the ball.

* * * * *